US011198964B2

(12) United States Patent
Son et al.

(10) Patent No.: US 11,198,964 B2
(45) Date of Patent: Dec. 14, 2021

(54) LAUNDRY TREATING APPARATUS AND METHOD OF THE SAME

(71) Applicant: LG Electronics Inc., Seoul (KR)

(72) Inventors: Kuyoung Son, Seoul (KR); Museung Kim, Seoul (KR); Hyeokdeok Kim, Seoul (KR); Byunghwan Ahn, Seoul (KR)

(73) Assignee: LG Electronics Inc., Seoul (KR)

( * ) Notice: Subject to any disclaimer, the term of this patent is extended or adjusted under 35 U.S.C. 154(b) by 170 days.

(21) Appl. No.: 15/663,184

(22) Filed: Jul. 28, 2017

(65) Prior Publication Data

US 2018/0202091 A1 Jul. 19, 2018

(30) Foreign Application Priority Data

Jan. 13, 2017 (KR) ..... 10-2017-0006093

(51) Int. Cl.
*D06F 29/00* (2006.01)
*D06F 33/52* (2020.01)
(Continued)

(52) U.S. Cl.
CPC ..... *D06F 29/005* (2013.01); *D06F 31/00* (2013.01); *D06F 33/32* (2020.02); *D06F 33/52* (2020.02);
(Continued)

(58) Field of Classification Search
CPC ..... D06F 29/00; D06F 29/005; D06F 31/00; D06F 33/00; D06F 33/02; D06F 2212/00;
(Continued)

(56) References Cited

U.S. PATENT DOCUMENTS

2009/0145174 A1 6/2009 Kim et al.
2015/0169194 A1* 6/2015 Ban ..... D06F 39/005 715/771
(Continued)

FOREIGN PATENT DOCUMENTS

CN 1648320 8/2005
CN 104508197 4/2015
(Continued)

OTHER PUBLICATIONS

Australian Office Action in Australian Application. No. 2017204095 dated Jul. 27, 2018, 8 pages.
(Continued)

*Primary Examiner* — David G Cormier
(74) *Attorney, Agent, or Firm* — Fish & Richardson P.C.

(57) ABSTRACT

A control method of a laundry treating apparatus including a first treating unit, a second treating unit, and a display unit includes displaying selection information on the display unit and receiving selection of at least one of the first or second treating units, based on selection of at least one of the first or second treating units, displaying the operation command performable by the selected treating unit and receiving
(Continued)

selection of the operation command, and based on the selected treating unit, performing the operation command and displaying a progressing state of the operation command.

11 Claims, 11 Drawing Sheets

(51) Int. Cl.

| | |
|---|---|
| ***D06F 58/36*** | (2020.01) |
| ***D06F 31/00*** | (2006.01) |
| ***D06F 33/32*** | (2020.01) |
| *D06F 25/00* | (2006.01) |
| *D06F 103/00* | (2020.01) |
| *D06F 105/58* | (2020.01) |
| *D06F 34/32* | (2020.01) |
| *D06F 101/00* | (2020.01) |
| *D06F 101/04* | (2020.01) |
| *D06F 101/10* | (2020.01) |
| *D06F 101/12* | (2020.01) |
| *D06F 101/20* | (2020.01) |

(52) U.S. Cl.
CPC ..... *D06F 58/36* (2020.02); *D06F 25/00* (2013.01); *D06F 34/32* (2020.02); *D06F 2101/00* (2020.02); *D06F 2101/04* (2020.02); *D06F 2101/10* (2020.02); *D06F 2101/12* (2020.02); *D06F 2101/20* (2020.02); *D06F 2103/00* (2020.02); *D06F 2105/58* (2020.02)

(58) Field of Classification Search
CPC ..... D06F 2212/02; D06F 2214/00; D06F 2216/00
See application file for complete search history.

(56) References Cited

U.S. PATENT DOCUMENTS

| | | | | |
|---|---|---|---|---|
| 2015/0345068 | A1* | 12/2015 | Coffman | D06F 58/28 715/771 |
| 2016/0215432 | A1 | 7/2016 | Kim | |
| 2017/0247827 | A1* | 8/2017 | Ramirez Olvera | D06F 33/02 |
| 2018/0057987 | A1* | 3/2018 | Li | D06F 31/00 |

FOREIGN PATENT DOCUMENTS

| | | |
|---|---|---|
| CN | 106032612 | 10/2016 |
| CN | 106032625 | 10/2016 |
| EP | 1548174 | 6/2005 |
| EP | 1882768 | 1/2008 |
| KR | 10-2002-0030222 | 4/2002 |
| KR | 10-2006-0101085 | 9/2006 |
| KR | 100652459 | 12/2006 |
| KR | 10-2012-0023497 | 3/2012 |
| WO | WO2016141714 | 9/2016 |
| WO | WO2016180158 | 11/2016 |
| WO | WO2017119674 | 7/2017 |

OTHER PUBLICATIONS

Extended European Search Report in European Application No. 17182164.8, dated Jan. 26, 2018, 10 pages.
European Office Action in European Application No. 17182164.8, dated May 27, 2019, 6 pages.
Chinese Office Action in Chinese Application No. 201710732291.7, dated Oct. 31, 2019, 27 pages (with English translation).

* cited by examiner

【FIGURE 1】
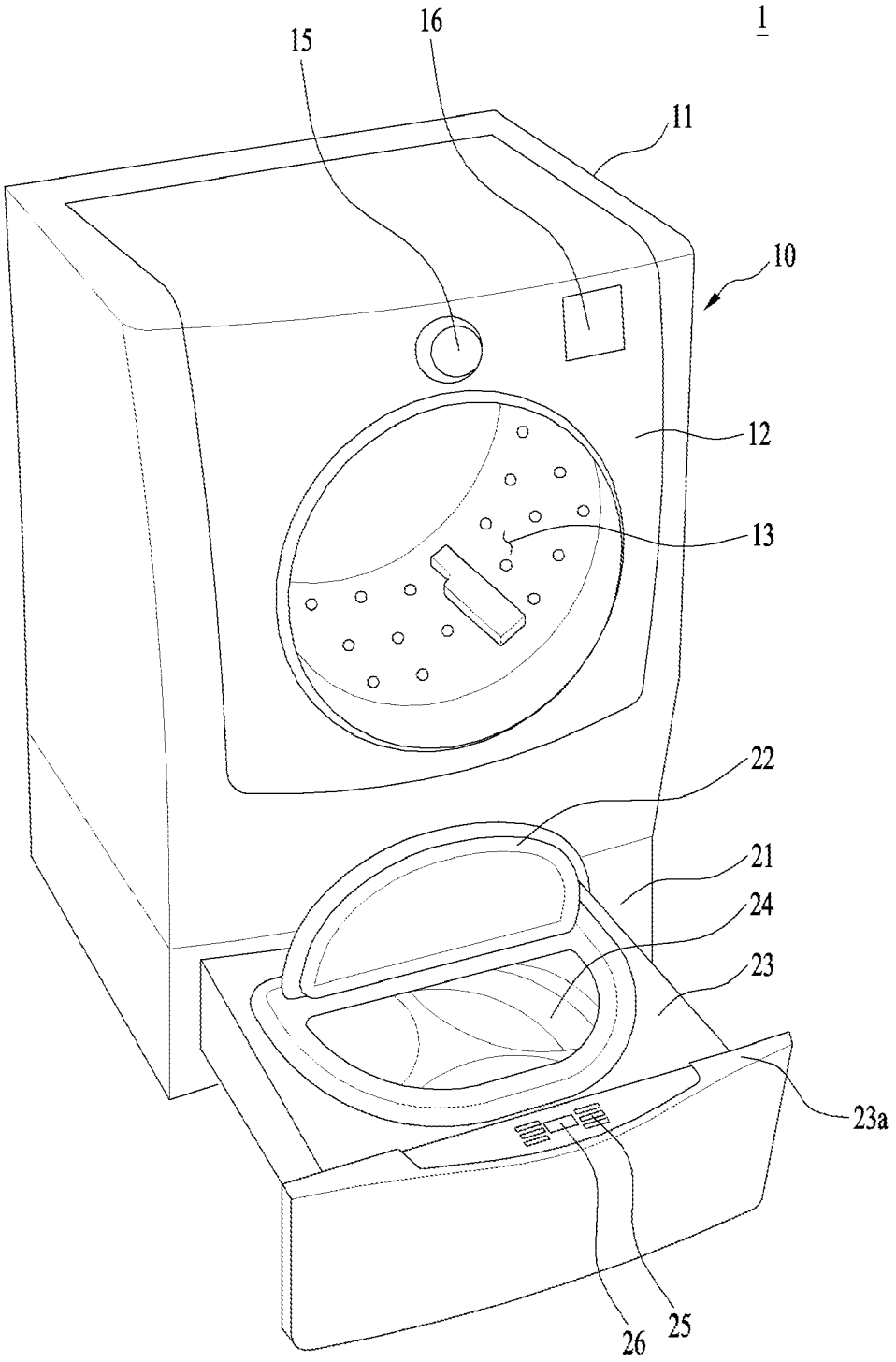

【FIGURE 2】
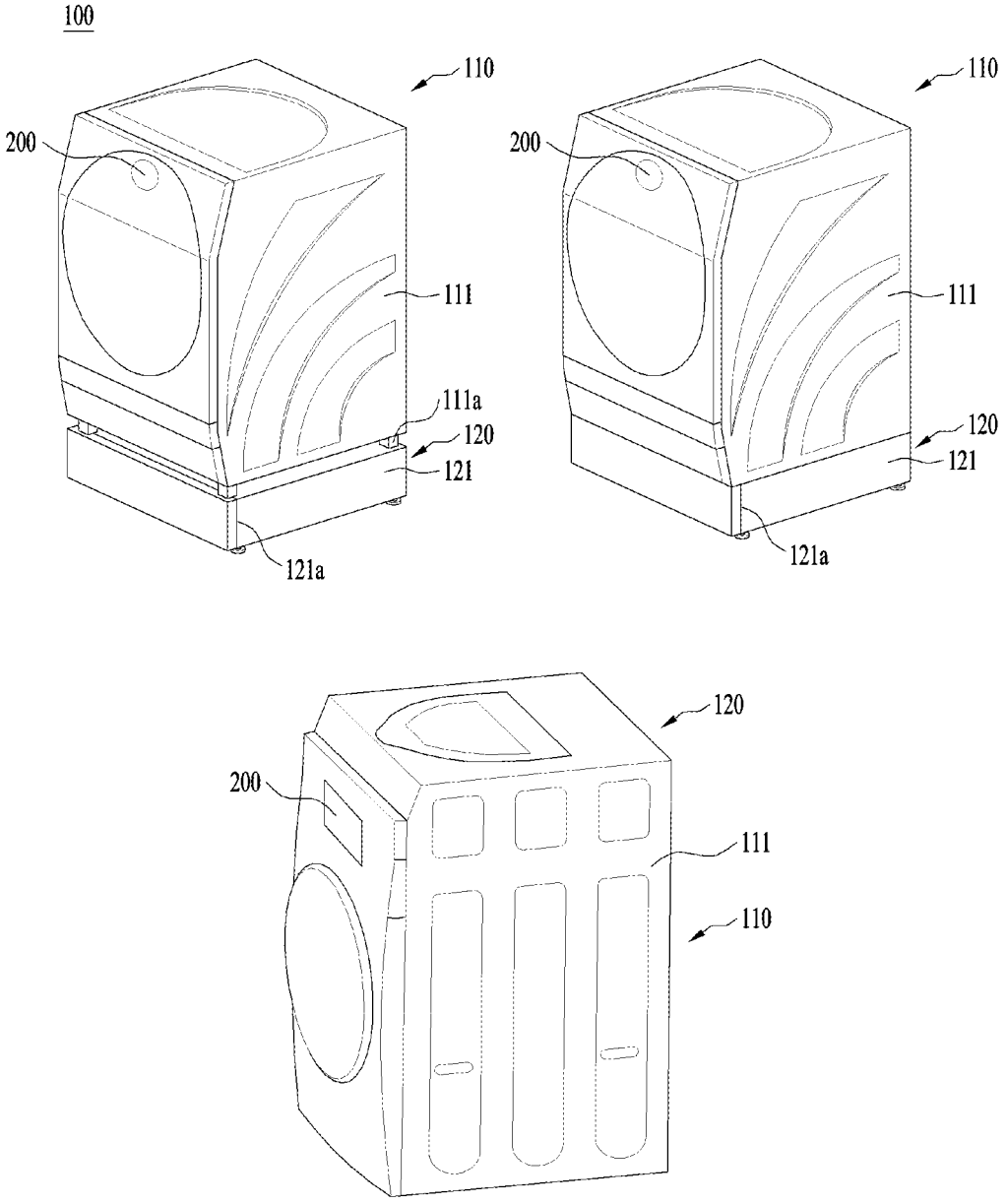

【FIGURE 3】
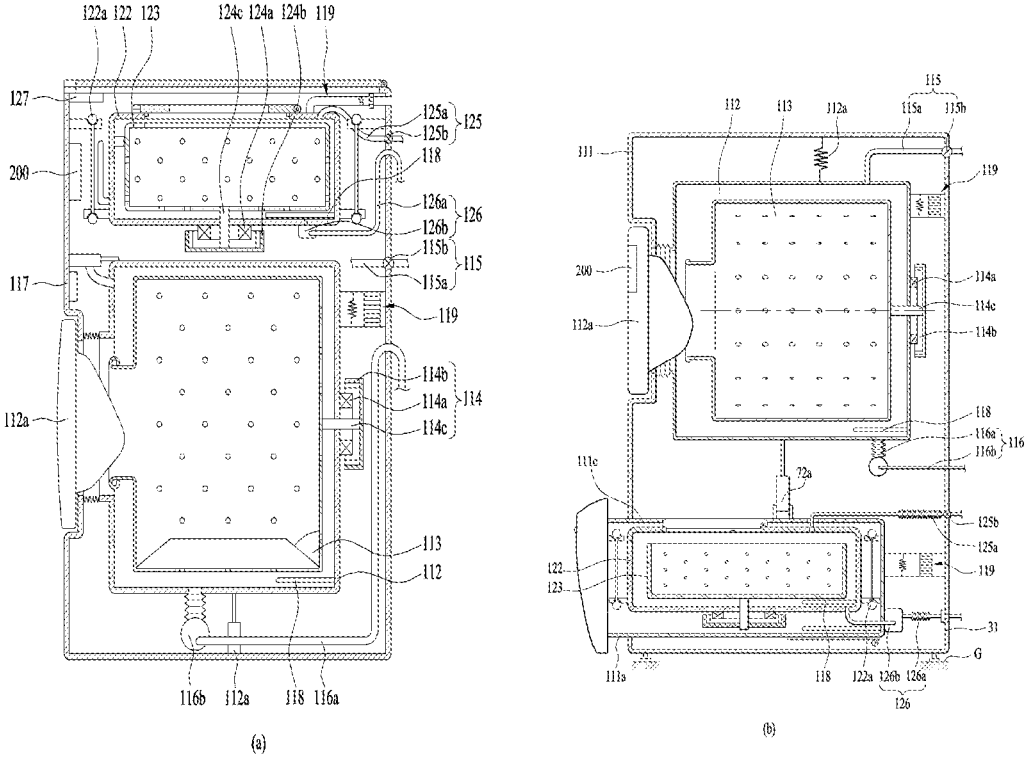

【FIGURE 4】
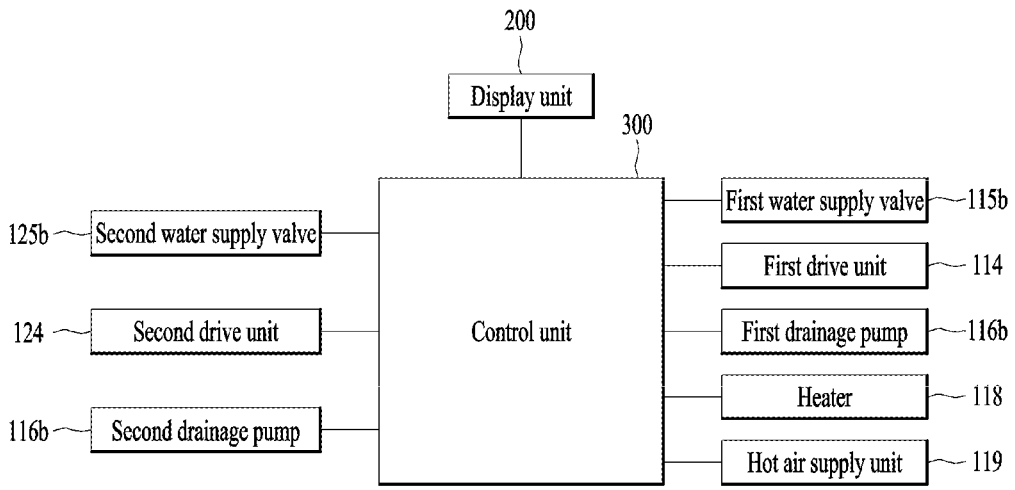
【FIGURE 5】
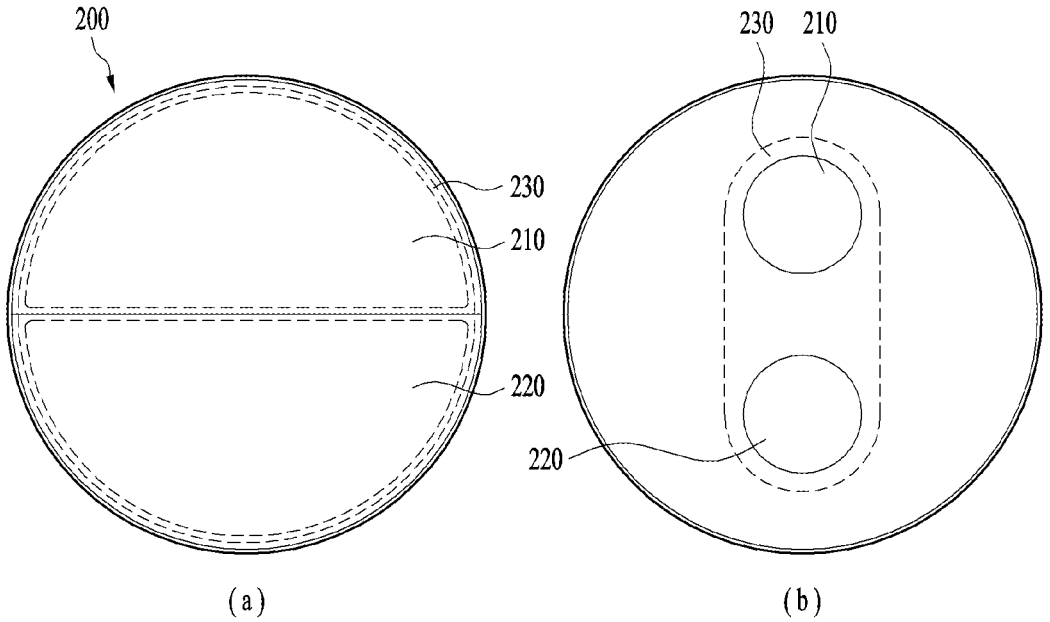

【FIGURE 6】
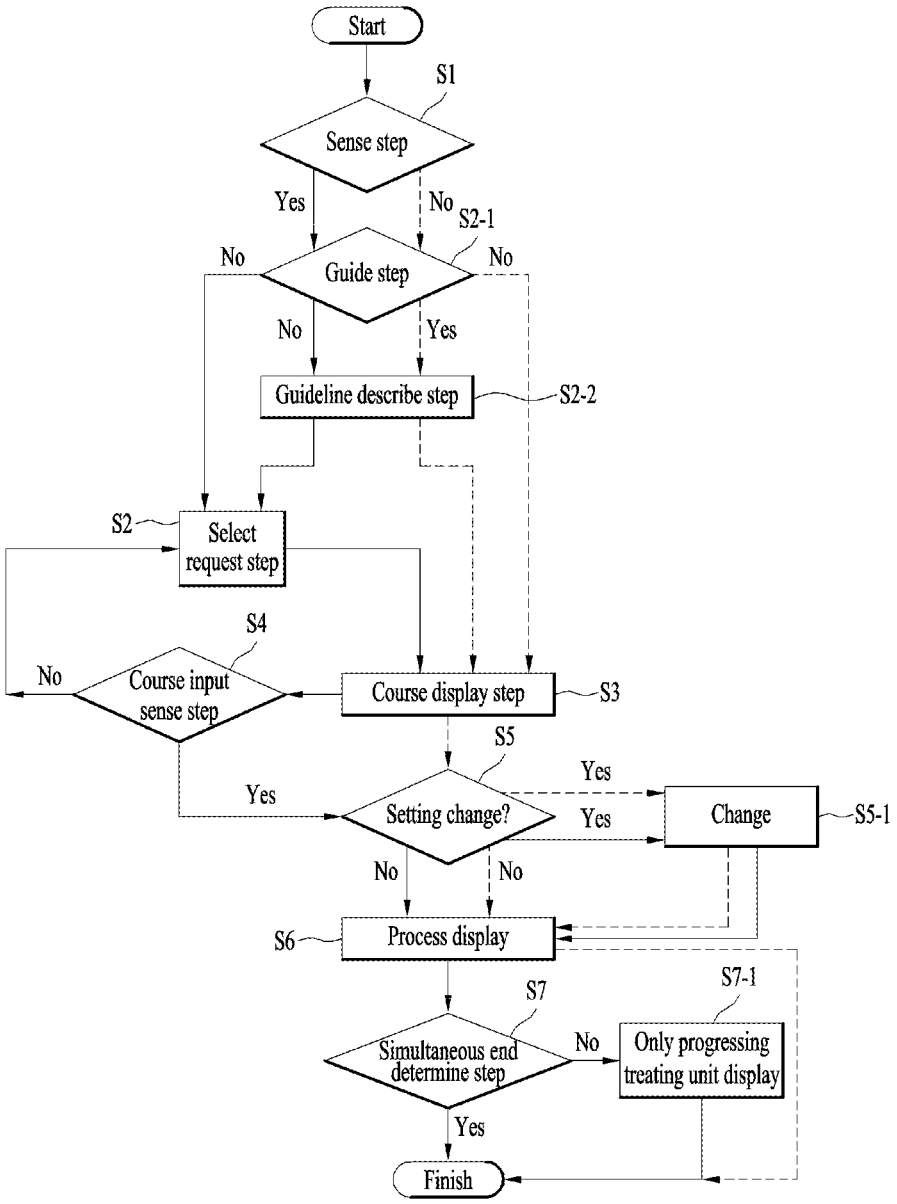

[FIGURE 7]
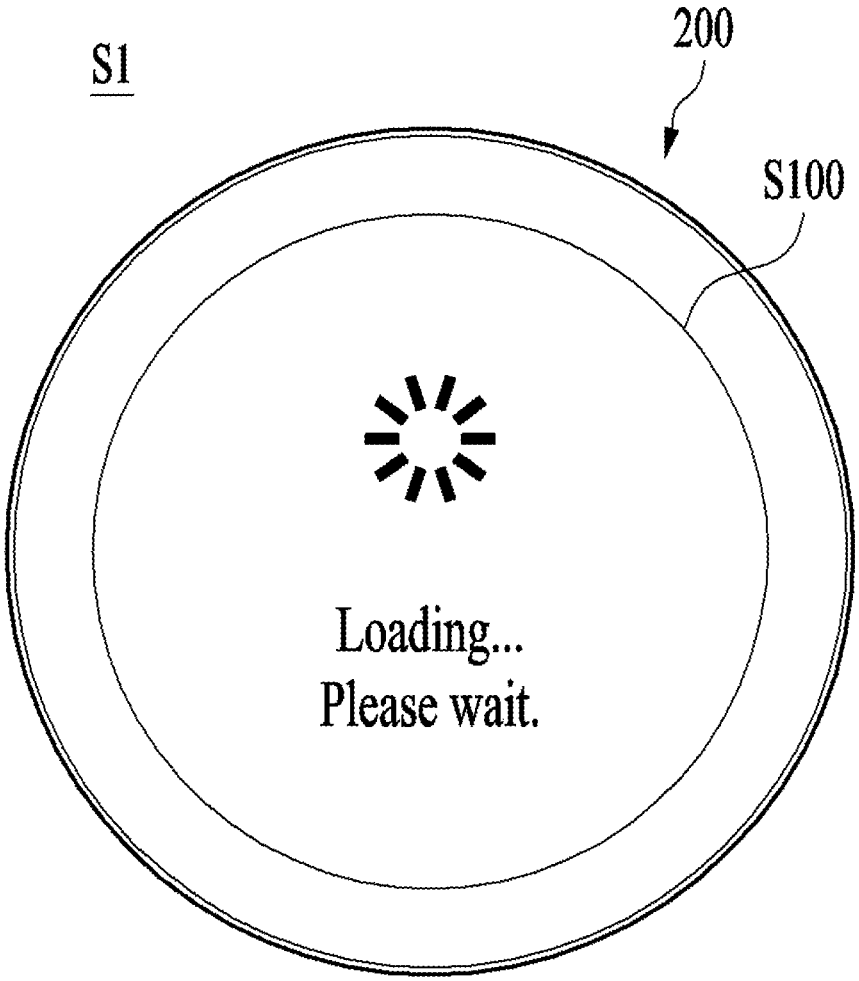

【FIGURE 8】
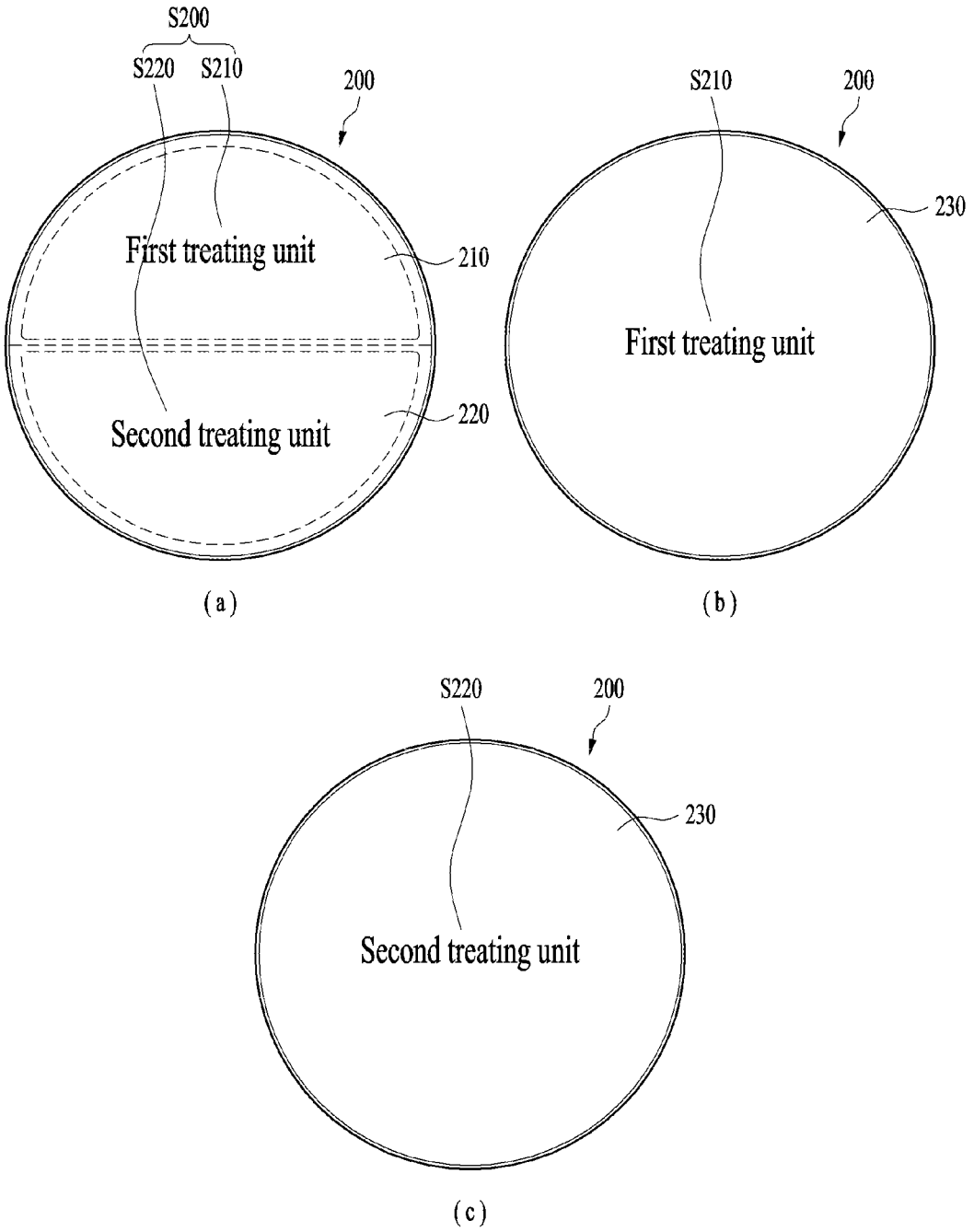

【FIGURE 9】
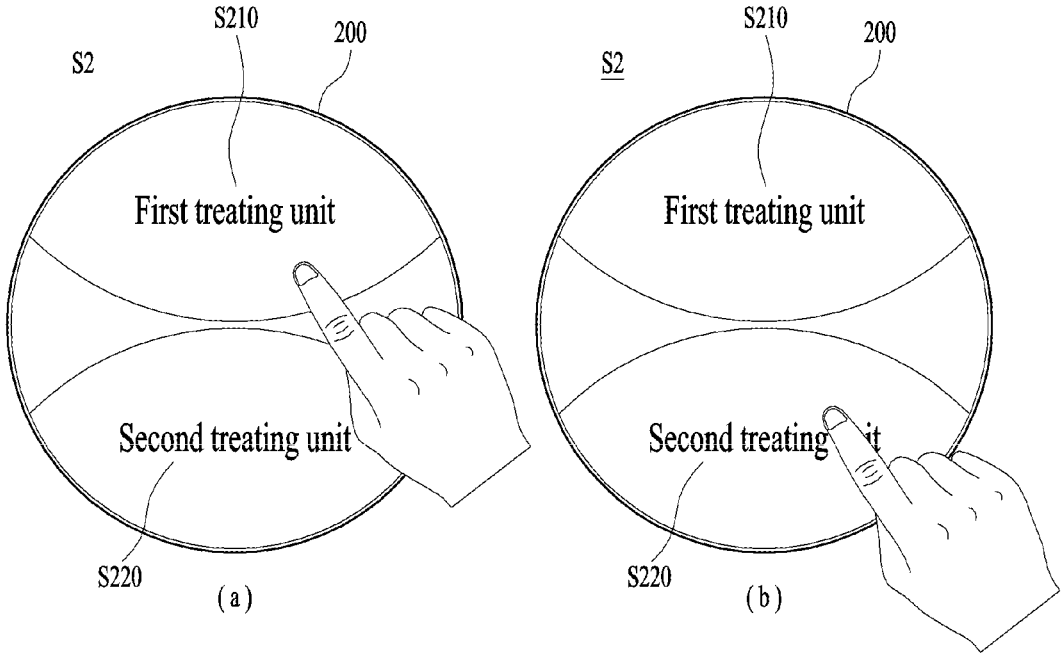

【FIGURE 10】
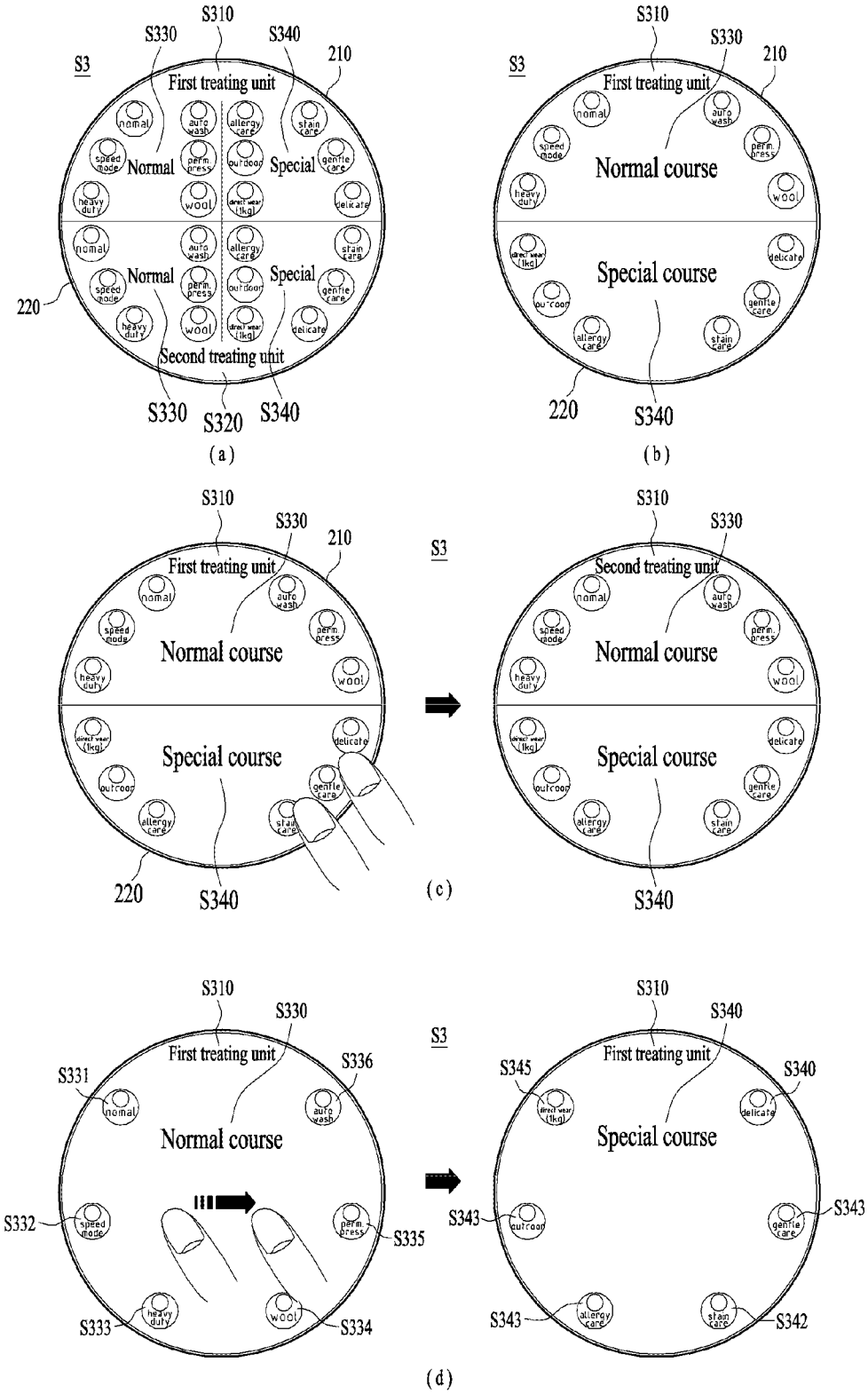

【FIGURE 11】
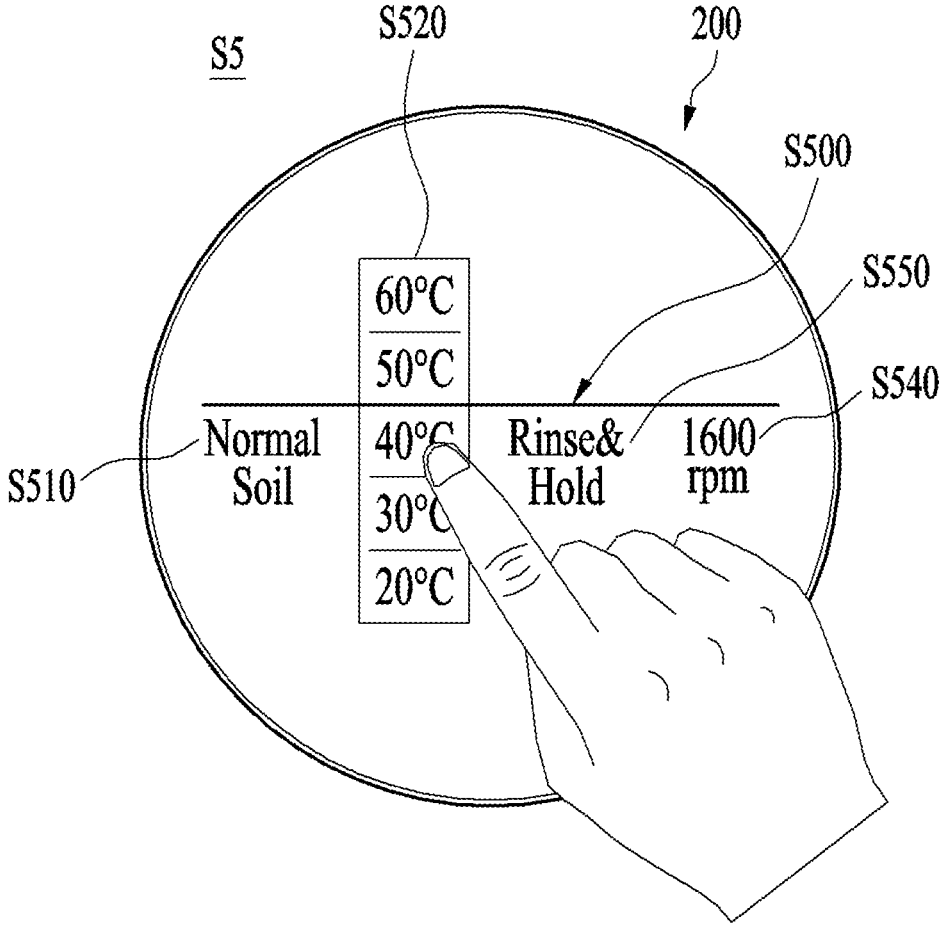

【FIGURE 12】
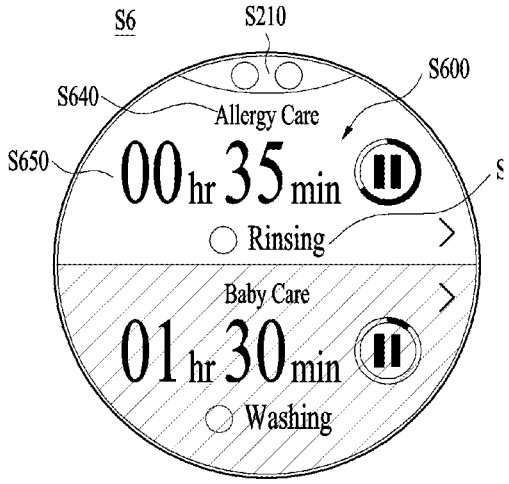
(a)
【FIGURE 13】
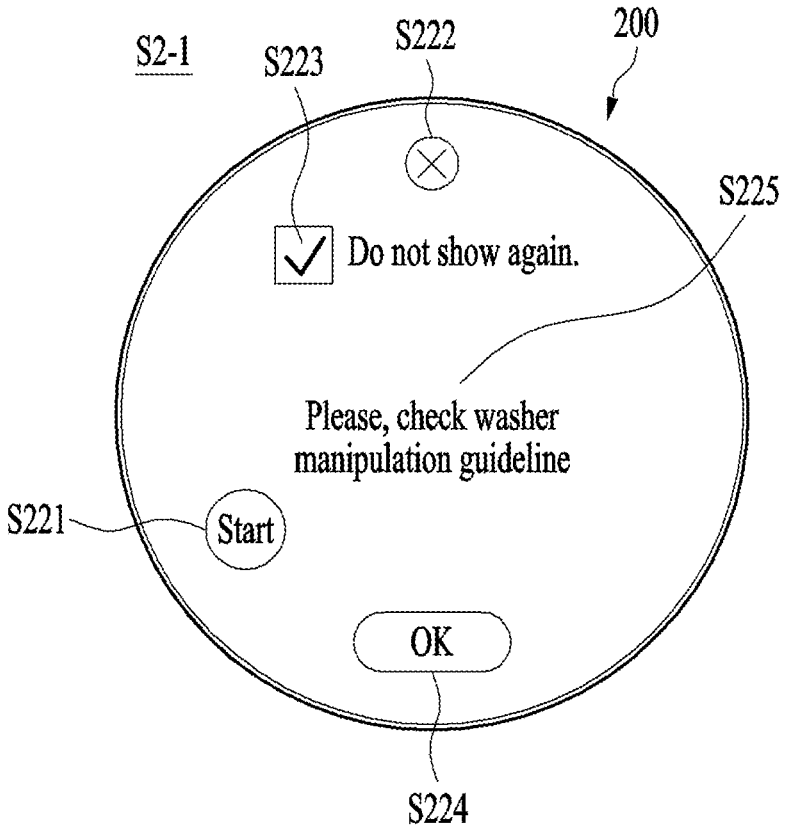

LAUNDRY TREATING APPARATUS AND METHOD OF THE SAME

CROSS-REFERENCE TO RELATED APPLICATIONS

Pursuant to 35 U.S.C. § 119(a), this application claims the benefit of earlier filing date and right of priority to Korean Application No. 10-2017-0006093, filed on Jan. 13, 2017 in Korea, the entire contents of which is hereby incorporated by reference herein in its entirety.

BACKGROUND OF THE DISCLOSURE

Field of the Disclosure

Embodiments of the present disclosure relate to a laundry treating apparatus and a method of the same.

Discussion of the Related Art

A laundry treating apparatus typically means an electric appliance for performing washing, drying or washing or drying clothes and other washing objects. Such a conventional laundry treating apparatus may be capable of performing only a washing or drying function or both of the washing and drying functions. A laundry treating apparatus including a steam supply device to have a refresh function for eliminating wrinkles, bad smell and static electricity from clothes has been released recently.

Meanwhile, the conventional laundry treating apparatus is classified based on a direction of laundry loading into a front load type and a top load type. A typical example of such a horizontal loading type is a drum type washing machine or drum type drying machine.

The front load type laundry treating apparatus has a front opening and a drum shaft parallel with or tilted a preset angle with respect the ground. The top load type laundry treating apparatus has a top opening and a drum shaft perpendicular to the ground.

Those laundry treating apparatuses tend to become large-sized in response to users demands. In other words, the exterior sizes of the laundry treating apparatuses for family use tend to become larger gradually.

In general, each house is equipped with one large-capacity laundry treating apparatus. The laundry treating apparatus is used several times to treat clothes and laundry after sorting the clothes and laundry based on kinds and types. For example, in case of sorting some laundry such as clothes for adults from lingerie or clothes for infants before washing, one washing process for the former is performed and another washing process for the latter is re-performed. Accordingly, the overall wash process takes much time and consumes much energy.

Moreover, in an aspect of energy economy, it is not preferred to use the conventional large-capacity laundry treating apparatus in washing a small amount of laundry. A wash course provided in the large-capacity laundry treating apparatus is usually for a large amount of laundry and then requires a lot of wash water. Also, such a wash course rotates a large drum or inner tub and then consumes much electricity.

The wash course is set for a large amount of laundry and it takes relatively much time.

The large-capacity laundry treating apparatus includes a wash course set mainly for normal clothes, so that it may not be appropriate for clothes made of delicate fabric such as lingerie or clothes for infants.

The large-capacity laundry treating apparatus is also inappropriate for a small amount of washing. Consumers usually collect clothes to wash for several days or more. It is not recommended to leave such lingerie and infant clothes which needs washing for a long time, considering sanitation. When such washing or laundry is neglected for a long time, contaminants or dirt might be stuck on fabric only not to be washed off completely.

Accordingly, there are increasing demands for smaller-capacity laundry treating apparatuses than the conventional large-capacity laundry treating apparatus.

However, it is not recommendable and does not look aesthetically good to install two laundry treating apparatuses side by side in a house, even two apparatuses are small-sized.

A new laundry treating apparatus is recently released which consists of a small-capacity laundry treating apparatus and a large-capacity laundry treating apparatus combined with each other to overcome the disadvantages of the conventional laundry treating apparatus.

FIG. 1 illustrates one example of the combined laundry treating apparatus. The laundry treating apparatus 1 includes a front load type laundry treating device 10 provided in a top portion as a large-capacity laundry treating device; and a bottom top load type laundry treating apparatus 20 as a drawer type small-capacity laundry treating device.

The front load type laundry treating device includes a cabinet 11 defining the external appearance and having an opening formed in the front; a front door 12 for opening and closing the opening; and a front laundry accommodating portion 13 provided in the cabinet 11 and accommodating clothes to wash. The top load type laundry treating device includes a top cabinet 21 defining the external appearance and having an opening formed in a top; a top drawer 23 retractable with respect to the top cabinet 21; a top door 22 for opening and closing the opening; and a second top laundry accommodating portion 24 provided in the top cabinet 21 and accommodating clothes to wash.

In case the front type laundry treating device 10 and the top load type laundry treating device 20 are washing machines, small-sized clothes are washed in the top load type laundry treating device and middle-and-large-sized clothes are washed in the front type laundry treating device, only to promote space application and save water, energy and time.

Meanwhile, the laundry treating apparatus may further include a first manipulation unit 15 for facilitating the user's manipulation of the front type laundry treating device 10; and a second manipulation unit 25 for facilitating the user's manipulation of the top load type laundry treating device 20, which is operable independently from the first manipulation unit.

Accordingly, whenever using the front type laundry treating device 10 and the top load type laundry treating apparatus 20, the user has to manipulate the manipulation units 15 and 25 separately.

Especially, to manipulate the second manipulation unit 25 located down under, the user has to bend the waist inconveniently and move a top drawer 23 partially.

In addition, a drawer panel 23*a* has to be more projected from the front of the top drawer 23 to enhance the user's access to the second manipulation unit 15.

Meanwhile, a first display unit 16 for displaying a current state of the front load laundry treating device 10 and a second display unit 26 for displaying a current state of the top load laundry treating device 20 are provided independent from each other.

Accordingly, the user has to check both the first display unit 16 and the second display unit 26 separately so as to check the states of the front type laundry treating device 10 and the top load laundry treating device 20.

In case the second display unit 26 is provided in a lower portion as shown in FIG. 1, it becomes difficult for the user to recognize the state.

In case the second display unit 26 is provided in the drawer panel 23*a*, the user has to partially move out the top drawer 23 from the top cabinet 21 inconveniently so as to check the second display unit 26.

Different from FIG. 1, another type laundry treating apparatus combined with the large-capacity laundry treating device and the small-capacity laundry treating device in a different way (for example, combined with a bottom front load type laundry treating device and a top top-load type laundry treating device) may also have disadvantages that a manipulation unit for manipulating the large-capacity laundry treating device and a manipulation unit for manipulating the small-capacity laundry treating device are provided separately and that a display unit for displaying the large-capacity laundry treating device and a display unit for displaying the small-capacity laundry treating device are provided separately.

SUMMARY OF THE DISCLOSURE

Embodiments of the present invention provide a laundry treating apparatus which may allow a user to manipulate a first laundry treating device (hereinafter, a first treating unit) and a second treating device (hereinafter, a second treating unit) by using one manipulation unit.

Embodiments of the present invention also provide a laundry treating apparatus which is capable of displaying current states of the first and second treating units by using one display unit and allowing the user to recognize the states easily.

Embodiments of the present invention also provide a laundry treating apparatus which may include a display unit capable of performing the function of the display unit and the function of the manipulation unit and facilitate the manipulation and displaying of the first and second treating units simultaneously.

Embodiments of the present invention also provide a laundry treating apparatus which may effectively control the first and second treating units by using one control unit.

Embodiments of the present invention also provide a laundry treating apparatus which may allow the user to effectively control the first and second laundry treating devices by controlling a display unit differently for a case of operating the first and second laundry treating devices simultaneously and a case of operating one of the two units.

Embodiments of the present invention also provide a laundry treating apparatus which may include one display unit integrally combined with a display unit for the first treating unit and a display unit for the second laundry treating device and be capable of maximizing user accessibility and state recognition.

Embodiments of the present invention also provide a laundry treating apparatus which may facilitate the user to clearly recognize and distinguish the case of using both of the first and second treating units simultaneously from the case of using one of the two devices by using one display unit.

Embodiments of the present disclosure also provide a control method of a laundry treating apparatus comprising a first treating unit performing at least one of a wash cycle configured to remove foreign substances from clothes and a dry cycle configured to dry moisture from clothes; and a second treating unit provided adjacent to the first treating unit and performing one or more of the wash cycle and the dry cycle; and a display unit displaying a current state of at least one treating unit or receiving an operation command for performing at least one of the wash and dry cycles, the control method comprising: a select request step for displaying select information on the display unit so as to allow the user to select at least one of the first and second treating units, when power is supplied to the display unit; a course display step for displaying the operation command performable in the selected treating unit on the display unit, when the select information is selected; and a process display step for displaying a processing state of the operation command performed in the selected treating unit on the display unit. The select information, the operation command and the progressing state of the operation command may be dividedly displayed on first and second regions which are provided in the display unit or a third region combined with the first and second regions.

The select information may include at least one of first select information for selecting the first treating unit and second select information for selecting the second treating unit.

The control method of the laundry treating apparatus may further comprise a sense step for sensing whether the first treating unit and the second treating unit are activated, wherein the select request step dividedly displays the first select information and the second select information on the first region and the second region, respectively, when the sense step senses that the first treating unit and the second treating unit are activated, and the select request step displays only the select information of the activated treating unit on the third region combined with the first and second regions, when the sense step senses that only one of the first and second treating units is activated.

Each of the first and second treating units may comprise a power supply unit for supplying power, and the sense step determines whether the first and second treating units are activated based on the state where power is supplied to the first and second treating units.

The sense step may display an operation ready state of the laundry treating apparatus on the display unit.

The course display step may dividedly display an operation command performable in the first treating unit on the first region and an operation command performable in the second treating unit on the second region, when both the first select information and the second select information are selected, and the course display step displays an operation command performable in the selected treating unit on the third region combined with the first and second regions, when the first select information or the second select information is selected.

The course display step may display an operation command performable in one of the first and second treating units on the third region combined with the first and second regions, when the first select information and the second select information are selected, and then displays an operation command performable in the other treating unit on the third region, when the select of the operation command performable in one of the first and second treating units is completed, and the course display step may display an operation command performable in the selected treating unit on the third region combined with the first and second regions, when the first select information or the second select information is selected.

The operation command displayed in the course display step may comprise a normal course comprises a course configured to perform at least one of a wash cycle for removing foreign substances from clothes and a rinse cycle for rinsing clothes; and a special course comprising an allergy care course for keeping clothes over a specific temperature for a preset time period, and a stain care course for removing stains from clothes by increasing the repeating number, duration time and cycle temperature of preset wash and rinse cycles.

The course display step may dividedly display the normal course and the special course on the first region and the second region of the display unit, respectively.

The course display step may display the normal course on the third region of the display unit, and displays the special course on the third region when an external force for sliding the display unit in one direction is applied.

The control method of the laundry treating apparatus may further comprise a course input sense step for sensing whether the operation command performable in the first treating unit and the operation command performable in the second treating unit are input in the course display step, when the first select information and the second select information are selected in the select request step, and sensing whether an operation command performable in the selected treating unit is input when the first select information or the second select information is selected in the select request step.

The course display step may be repeated, when the operation command performable in the selected treating unit is not input in the course input sense step.

The control method of the laundry treating apparatus may further comprise a setting change step for changing at least one piece of setting information including the preset laundry amount, the temperature, the drum RPM and the repeated number of the rinsing cycle, when the input of the operation command is complete in the course display step.

The setting change step may dividedly display the setting information on the display unit. When the divided region is pressed, the setting change step may display at least one of the changeable setting information. When one region of the displayed regions of the changed setting information is selected, the setting change step may change the setting information into the selected setting information.

The preset operation command may be performed, when there is no input in the setting change step for a preset time period.

The progress display step may dividedly display a progressing state of the first treating unit on the first region and a progressing state of the second treating unit on the second region, when the operation command is performed in the first and second treating units simultaneously, and the progress display step may display only the progressing state of the treating unit where the operation command is performed on the third region combined with the first and second regions, when the operation command is performed in one of the first and second treating units.

The control method of the laundry treating apparatus may further comprise an end determine step for determining whether at least one of the first and second treating units ends the operation when the operation command is performed in the first and second treating units simultaneously, wherein the end determine step displays a progressing state of the other treating unit on the third region, when the performance of the operation command is ended in one of the first and second treating units.

The control method of the laundry treating apparatus may further comprise a guide step for displaying guidelines of a display unit manipulation on the display unit, when power is supplied to the laundry treating apparatus.

The guide step may display icons for start, no re-start and remove of the manipulation guideline and confirm of the remove, no re-start and start of the manipulation guideline on the display unit.

Embodiments of the present disclosure also provide a laundry treating apparatus comprising a first treating unit for washing or drying clothes; a second treating unit provided in at least one of upper, lower and lateral portion of the first treating unit and washing or drying clothes; and a display unit displaying current states of the first and second treating units and displaying screens related with the first and second treating units to allow a user to input an operation command performed in the first and second treating units to wash or dry clothes.

The display unit dividedly may display the screens related with the first and second treating units, when the first and second treating units are activated, and the display unit may display only a screen related with the activated treating unit, when one of the first and second treating units is activated.

The laundry treating apparatus may further comprise a control unit for determining whether the first and second treating units are activated, wherein the control unit determines whether the first and second treating units are activated based on the power supply to the first and second treating units.

Accordingly, the laundry treating apparatus is capable of facilitating the user to select the first treating unit and the second treating unit easily by using one display unit and determine an operate command and recognize a current operation state of the selected treating unit.

Furthermore, the laundry treating apparatus is capable of facilitating the user to clearly recognize and distinguish the case of using both of the first and second treating units simultaneously from the case of using one of the two devices by using one display unit.

Still further, the laundry treating apparatus is capable of allowing a user to manipulate a first laundry treating device (hereinafter, a first treating unit) and a second laundry treating device (hereinafter, a second treating unit) by using one manipulation unit.

Still further, the laundry treating apparatus is capable of displaying current states of the first and second treating units by using one display unit and allowing the user to recognize the states easily.

Still further, the laundry treating apparatus may include a display unit capable of performing the function of the display unit and the function of the manipulation unit and facilitate the manipulation and displaying of the first and second treating units simultaneously.

Still further, the laundry treating apparatus is capable of effectively controlling the first and second treating units by using one control unit.

Still further, the laundry treating apparatus is capable of allowing the user to effectively control the first and second laundry treating devices by controlling a display unit differently for a case of operating the first and second laundry treating devices simultaneously and a case of operating one of the two units.

Still further, the laundry treating apparatus may include one display unit integrally combined with a display unit for the first treating unit and a display unit for the second laundry treating device and be capable of maximizing user accessibility and state recognition.

BRIEF DESCRIPTION OF THE DRAWINGS

The accompanying drawings are included to provide a further understanding of the present invention, and are incorporated in and constitute a part of this specification. The drawings illustrate exemplary embodiments of the present invention and, together with the description, serve to explain principles of the present invention. In the drawings:

FIG. 1 is a diagram illustrating one example of a conventional laundry treating apparatus;

FIG. 2 is a diagram illustrating various embodiments of a laundry treating apparatus in accordance with the present disclosure;

FIG. 3 is a diagram illustrating a control method of the laundry treating apparatus;

FIG. 4 is a diagram illustrating a shape of a display unit in accordance with the present disclosure;

FIG. 5 illustrates one embodiment of the display unit in a sense step in accordance with the present disclosure;

FIG. 6 illustrates one embodiment of a display unit in a selecting request step;

FIG. 7 illustrates a control method of the laundry treating apparatus in accordance with the present disclosure;

FIG. 8 illustrates one embodiment of a screen which is displayed on a display unit in the selecting request step;

FIG. 9 illustrates one embodiment that a user selects one of the treating units which will be operated in the select requesting step;

FIG. 10 illustrates embodiments of the screen displayed on the display unit in a course display step;

FIG. 11 illustrates one embodiment of a screen displayed on the display unit in a setting change step;

FIG. 12 illustrates one embodiment of a screen displayed on the display unit in a process state display step; and FIG. 13 illustrates one embodiment of a screen displayed on the display unit in a guide step.

DESCRIPTION OF SPECIFIC EMBODIMENTS

Preferred embodiments of the present invention will be described below in more detail with reference to the accompanying drawings. The present invention may, however, be embodied in different forms and should not be constructed as limited to the embodiments set forth herein.

Hereinafter, exemplary embodiments of the present disclosure are described in detail, referring to the accompanying drawings. Rather, these embodiments are provided so that this disclosure will be thorough and complete, and will fully convey the scope of the present invention to those skilled in the art. Description of a refrigerator will now be given in detail according to exemplary embodiments disclosed herein, with reference to the accompanying drawings.

FIG. 2 illustrates embodiments of a laundry treating apparatus combined with two or more laundry treating devices including a display unit and a manipulation unit, respectively.

The laundry treating apparatus 100 may include a first treating unit 110 as main laundry treating device and a second treating unit 120 as sub-laundry treating device.

The first treating unit 110 may be provided as a washer configured to perform a wash cycle for removing foreign substances from clothes or a dryer configured to perform a dry cycle for drying moisture contained in the clothes.

In case the first treating unit 110 is provided as the washer, the first treating unit 110 may perform the drying cycle for drying clothes.

The second treating unit 120 may be also provided as the washer configured to perform the wash cycle for removing foreign substances from clothes or the dryer configured to drying the clothes containing moisture.

In case the second treating unit 120 is provided as the washer, the second treating unit 120 may perform the dry cycle for drying the clothes.

The first treating unit 110 may have a larger size than the second treating unit 120 to have a larger washing-drying capacity than the second treating unit 120.

That is to facilitate the second treating unit 120 to wash or dry a small amount of clothes including lingerie and clothes for infants rapidly, while saving energy.

The second treating unit 120 may be coupled to the first treating unit 110 (see FIG. 2 (*a*)) independently or integrally formed with the first treating unit 110 (see FIGS. 2 (*b*) and (*c*)).

At this time, even though the first treating unit 110 and the second treating unit 120 are independently provided, one display 200 may be provided to display operational states of the first and second treating units 110 and 120 and receive an operation command for controlling the first and second treating units 110 and 120 to perform at least one of the wash cycle and the dry cycle.

In other words, the display unit 200 may be provided in at least one of the first and second treating units 110 and 120, even when the first and second treating units 110 and 120 are independently provided or integrally formed as one body.

The display unit 200 may include a display panel for displaying a state of the first treating unit 110 and a state of the second treating unit 120.

At this time, the display unit 200 may be a touch panel to function as a manipulation unit configured to allow the user to input an operation command to the first treating unit 110 and the second treating unit 120.

Specifically, the display unit 200 may function as the display unit and the manipulation unit for the first and second treating units 110 and 120.

Meanwhile, the display unit 200 is connected with a control unit for controlling the first and second treating units 110 and 120 simultaneously and transceive a control signal with the control unit.

The control unit may include a sensor for sensing current states of the first and second treating units 110 and 120 and transmit the sensed states to the display unit 200. The display unit 200 may display the current states of the first and second treating units 110 and 120.

When an operation command is input to the display unit 200, the display unit 200 transmits the operation command to the control unit and the control unit put the first and second treating units 110 and 120 into operation.

Both of the first and second treating units 110 and 120 may be manipulated and controlled by using one display unit 200, so as to maximize the user's convenience.

Moreover, the display unit 200 is capable of displaying the current state of the first treating unit 110 and the current state of the second treating unit 120, so that the user can recognize the currents state of the first and second treating units 110 and 120 at the same time.

Hereinafter, specific configuration of the laundry treating apparatus is described, referring to FIGS. 2 and 3.

Referring to FIG. 2 (*a*), the second treating unit 120 may be independently provided from the first treating unit 110 and it may be coupled to the first treating unit 110 only to form one laundry treating apparatus.

When the second treating unit 120 is separately provided from the first treating unit 110, the first treating unit 110 may include a first cabinet 111 defining the external appearance and the second treating unit 120 may include a second cabinet 121 defining the external appearance and independently provided from the second cabinet 111.

Meanwhile, the second treating unit 120 may be arranged on or under the first treating unit 110 or on a lateral surface of the first treating unit 110 side by side.

In other words, the second treating unit 120 may be arranged in any one of the upper, lower and lateral portion of the first treating unit 110, only if the second treating unit separable from the first treating unit 110 is provided together with the first treating unit as one body.

The first treating unit 110 may be provided as a front load type laundry treating device and the second treating unit 120 may be a top load type laundry treating device.

In this instance, the second treating unit 120 may be a drawer type so as to avoid interference with the front load type laundry treating device.

Specifically, the second treating unit 120 may include a drawer 121*a* movable from the second cabinet 121 outward; and a laundry accommodating portion provided in the drawer 121*a*.

As the first treating unit 110 is disposed on the second treating unit 120, a plurality of connecting members 111*a* may be disposed on an upper surface of the second cabinet 112 of the second treating unit 120 and a plurality of grooves (not shown) receiving the connecting members 111*a* may be provided in an upper portion of the second cabinet 112 of the second treating unit 120.

Meanwhile, when the top of the second treating unit 120 is coupled to the first treating unit 110, only the control unit provided one of the first and second treating units 110 and 120 is configured to integrate the control of the first and second treating units 110 and 120.

For that, the connecting members 111 may be provided as connectors configured to transmit electrical signals of the first and second treating units 110 and 120.

The second treating unit 120 may be configured to operate only when the first treating unit 110 is disposed thereon, so as to prevent the turn-over after the drawer 121*a* is moved outward.

The display unit 200 may be provided in the first treating unit 110 to display the current states of the first and second treating units 110 and 120 and to input operation commands to the first and second treating units 110 and 120.

FIG. 2 (*a*) illustrates one embodiment of the first treating unit 110 and the second treating unit 120 which are independently coupled to each other. It is not excluded that the first treating unit 110 is the top load type and the second treating unit 120 is the front type.

It is also possible to arrange the second treating unit 120 in any portions of the first treating unit 110, for example, an upper portion, a lower portion and a lateral portion of the first treating unit 110.

In FIGS. 2 (*b*) and (*c*), the first treating unit 110 is the front load type and the second treating unit 120 is the top load type. FIG. 2 (*b*) shows the second treating unit 120 provided under the first treating unit 110. FIG. 3 (*c*) shows the second treating unit 120 provided on the first treating unit 110.

Referring to FIG. 2 (*b*), the first treating unit 110 and the second treating unit 120 may be provided in one cabinet 111 defining the external appearance.

The second treating unit 120 may include the drawer 121*a* movable front the cabinet 111 forward to avoid the interference with the first treating unit 110; and the laundry accommodating portion provided in the drawer 121.

The display unit 200 may be in the cabinet 111 and configured to display the current states of the first and second treating units 110 and 120 and input operation commands to the first and second treating units 110 and 120.

At this time, the first treating unit 110 is provided on the second treating unit 120 so that the display unit 200 may be provided in the cabinet 111 where the first treating unit 110 is provided.

Referring to FIG. 2 (*c*), the first and second treating units 110 and 120 may be provided in one cabinet 111 defining the external appearance.

The display unit 200 may be provided in the cabinet 111 and configured to display the current states of the first and second treating units 110 and 120 and input operation commands to the first and second treating units 110 and 120.

At this time, the second treating unit 120 is provided on the first treating unit 110 so that the display unit 200 may be provided in the cabinet 111 where the second treating unit 120 is provided.

FIG. 3 illustrates internal configuration of the laundry treating apparatus in accordance with the present disclosure.

FIG. 3 (*a*) illustrates that the first treating unit 110 is provided on the second treating unit 120 and FIG. 3 (*b*) illustrates that the first treating unit 110 is provided under the second treating unit 120.

FIG. 3 (*a*) and FIG. 3 (*b*) illustrate that the first treating unit 110 and the second treating unit 120 are provided in one cabinet 111. That is for convenient description sake and it is possible to arrange the first treating unit 110 and the second treating unit 120 are independently provided in cabinets, respectively.

FIGS. 3 (*a*) and (*b*) illustrate that the first treating unit 110 is the front load type and the second treating unit 120 is the top load type. That is also for convenient description sake and the reverse case is possible.

In case the first and second treating units 110 and 120 are washers, the first treating unit 110 may include a first tub 112 provided in the cabinet 111 and holding water; a first drum rotatably mounted in the first tub 112 and accommodating clothes to wash; a first drive unit 114 provided in one surface of the first tub 112 and configured to rotate the first drum 114; a first water supply unit 115 for supplying water to the first tub 112; and a first drainage unit for draining water from the first tub 112.

The first drive unit 114 may include a first stator 114*a* configured to form a rotation magnetic field; a first rotor 114*b* rotatable by the rotation magnetic field; and a shaft 114*c* connecting the rotor with one surface of the drum. As alternative example, the first drive unit may include a motor provided in a predetermined portion of the first tub 112; a shaft projected from a rear surface of the tub and connecting one surface of the drum to the tub; a pulley provided in the shaft and the motor; and a belt connecting the pulleys with each other.

The first water supply unit 115 may include a first water supply pipe 115*a* connecting the first tub 112 to an external water supply source; and a first water supply valve 115*b* for adjusting the water flow of the first water supply pipe 115*a*.

The first drainage unit 116 may include a first drainage pipe 116*a* extended from the first tub 112 to the outside of the cabinet 111; and a first drainage pump 116*b* providing a power for draining water from the first tub 112, in communication with the first drainage pipe 116*a*.

The second treating unit 120 may include the same components only with the difference sizes.

Specifically, the second treating unit 120 may include a second tub 122 provided in a top, bottom or lateral surface of the first treating unit 110 within the cabinet 111 and holding water; a second drum 123 rotatably mounted in the second tub 122 and accommodating clothes to wash; a second drive unit 124 provided in one surface of the second tub and configured to rotate the second drum; a second water supply unit 125 for supplying water to the second tub 120; and a second drainage unit 127 for draining water from the second tub 120.

Meanwhile, the first treating unit 110 may include a first support 112*a* supporting the first tub 112 in the cabinet 111 and the second treating unit 120 may include a second support 122*a* supporting the second tub 122 in the cabinet 111.

The first support 112*a* and the second support 112*a* may be provided as combination of a spring and a damper or combination of a bracket and a connect bar.

The first support 112*a* and the second support 122*a* may be formed in any shapes only if capable of supporting the first tub 112 and the second tub 122.

Meanwhile, the cabinet 111 may further include a partition wall 111 partitioning off the first and second treating units 110 and 120 from each other.

When the second treating unit 120 is the drawer type, the drawer 111*a* movable from the cabinet 111 outward may be provided and the second tub 122 and the second drum 123 may be provided in the drawer 111*a*.

The second drive unit 124 may include a second stator 124*a* forming a rotation magnetic field; a second rotor 122*b* rotatable by the rotation magnetic field; and a second shaft 122*b* connecting the rotor to one surface of the drum.

As alternative example, the second drive unit may include a motor provided in a predetermined portion of the second tub 122; a shaft projected from a rear surface of the tub and connecting one surface of the drum to the tub; a pulley provided in the shaft and the motor; and a belt connecting the pulleys with each other.

The second water supply unit 125 may include a second water supply pipe 125*a* connecting the second tub 122 to an external water supply source; and a second water supply valve 125*b* for adjusting the water flow of the second water supply pipe 125*a*.

The second drainage unit 126 may include a second drainage pipe 126*a* extended from the second tub 122 to the outside of the cabinet 111; and a second drainage pump 126*b* providing a power for draining water from the second tub 122, in communication with the second drainage pipe 126*a*.

The first treating unit 110 may further include a first heater 118 for heating the water held in the first tub 110; and a hot air supply unit 119 for supplying heated or hot air to the first tub 110.

It is preferred that the first heater 118 is provided below the first tub 110 and a sheath heater may be provided as the first heater.

Of course, the first heater 118 may be formed in any shapes only if capable of heating the water inside the first tub 110.

The hot air supply unit 119 may include a duct 119*a* for supplying air to the first tub 110; a duct heater 119*b* provided in the duct 119; and a fan 119*c* blowing air to the first tub 110 from the duct 119*b*.

The second treating unit 120 may also include a heater 118 and a hot air supply unit 119, like the first treating unit 110.

Meanwhile, the first treating unit 110 and the second treating unit 120 may include power supply units for supplying power thereto, respectively.

The power supply unit may include a switch provided in the cabinet 111 and connected to an external power supply source. It is preferred that the switch is provided in a preset portion of the display unit 200.

The power supply unit may include a first power supply unit for supplying power to the first treating unit 110; and a second power supply source for supplying power to the second treating unit 120.

Meanwhile, at least one of the first and second treating units 110 and 120 may be a dryer.

One of the first and second treating units 110 and 120 provided as dryer may include no water supply unit, no drainage unit, no tub and no heater.

Referring to FIG. 4, the laundry treating apparatus may further include a control unit 300 configured to controlling the first and second treating units 110 and 120.

The control unit is capable of controlling all of the configurations provided in the first and second treating units 110 and 120.

The control unit 300 may be connected with the display unit 200 to transceiver a control signal.

The control unit 300 may be integrally formed with the display unit 200 as one body or independently formed from the display unit 200.

The first water supply valve 115*b*, the second water supply valve 125*b*, the first drive unit 114, the second drive unit 124, the first drainage pump 116*b* and the second drainage pump 126*b*. Also, the control unit may control the heater 118 and the hot air supply unit 119 provided at least one of the first and second treating units.

As mentioned above, the connect member 111*a* for electrically connecting the first and second treating units 110 and 120 with each other may be provided in case they are independently provided.

The connect member 111*a* may function to transmit a control signal of the control unit 300 provided in one of the first and second treating units 110 and 120.

FIG. 5 illustrates the display unit 200 of the laundry treating apparatus in accordance with the present disclosure.

The display unit 200 may be formed in any shapes only if capable of displaying current states of the first and second treating units 110 and 120 or allowing the user to input operation commands of the first and second treating units 110 and 120.

In FIG. 5, the display unit 200 is provided in a circular shape.

The display unit 200 may be a touch panel so as to receive the operation command by enabling the overall region to sense an external force or electricity of the surface.

The display unit 200 may include a first region 210 and a second region 220 which are distinguished from each other.

Both of the first and second regions 210 and 220 are capable of displaying screens and sensing the external force or electricity to receive the operation command.

The first and second regions 210 and 220 may be provided by dividing the display unit 200 (see FIG. 5 (*a*)) or a predetermined region of the display unit 200 is formed as the first region 210 and another region distant from the first region is formed as the second region 220 (see FIG. 5 (*b*)).

Meanwhile, different from what is shown in the drawings, the first region 210 and the second region 220 may be provided side by side.

The display unit 200 may display a screen on the full region so that the first region 210 and the second region 220 can selectively display a screen based on a specific control signal.

The display unit 200 may further include a third region 230 provided as the integration of the first and second regions 210 and 220.

The third region 230 may occupy the full screen of the display unit 200. When the first region 210 and the second region 220 are formed in some region of the display unit 200, the third region 230 may be overlapped with the first and second regions 210 and 220.

Accordingly, the display unit 200 may display the current states of the first and second treating units and screens related with the first and second treating units so as to receive operation commands configured to wash or dry clothes in the first and second treating units.

The currents states of the first and second treating units mean a state where the first and the second treating units 110 and 120 are linked to the control unit 300 or the display unit 200. The screen capable of receiving the operation commands mean the courses for performing washing or drying cycles in the first and second treating units 110 and 120.

Hereinafter, it is described that the display unit 200 displays screens related with the first and second while describing a control method of the laundry treating apparatus.

FIG. 6 illustrates a control method for controlling the first and second treating units 110 and 120 by using one display unit 200. FIGS. 7 through 13 illustrate screens displayed on the display unit 200 in steps of the control method.

When the power is supplied to the display unit 200, the control unit 300 is implemented to perform a sense step (S1) for sensing whether the first treating unit 110 and the second treating unit 120 are activated on the display unit 200. The sense step (S1) may be implemented to display an operation preparing state S100 of the laundry treating apparatus on the display unit 200 such as booting or loading (see FIG. 7).

Because of that, the user might fail to recognize that the sense step (S1) is implemented.

The state where the first and second treating units 110 and 120 are activated may mean a state where the first and second treating units 110 and 120 are ready to receive and perform an operation command from the display unit 200 or the control unit 300.

In addition, the state where the units 110 and 120 are activated may mean a state where they are linked to the display unit and ready to transmit their current states to the display unit 200.

For example, when the first power supply unit 118 is input to the first treating unit 110 or the second power supply unit 128 is input to the second treating unit 120, it is determined that the first or second treating unit 110 or 120 is activated.

Once the sense step (S1) senses that both of the first and second treating units 110 and 120 are activated, a selection request step (S2) for displaying select information S200 for allowing the user to select the first and second treating units 110 and 120 on the display unit 200 may be performed.

Specifically, the select request step (S2) is implemented to allow the user to select the unit to control or operate. The select information S200 may mean that names of the activated treating unit are displayed on the display unit 200 (for example, the first treating unit and the second treating unit).

In other words, the select request step (S2) means that the treating unit the user selects to control or operate is specified.

At this time, the select information S200 may include a first select information s210 for selecting the first treating unit 110; and second select information s220 for selecting the second treating unit 120 (see FIG. 8 (*a*)).

When it is sensed in the sense step (S1) that both of the first and second treating units and 110 and 120 are activated, the select request step (S2) may display the first select information S210 in the first region 210 and the second select information S220 in the second region 220 distinguishably.

In this instance, the display unit 200 is divided into top and bottom regions as the first and second regions 210 and 220. The first select information S210 is displayed on the first region 210 and the second select information S220 is displayed on the second region 220 (see FIG. 8 (*a*)).

Alternatively, the display unit 200 may be divided into left and right regions as the first and second regions 210 and 220. The first select information and the second select information may be displayed in the first region 210 and the second region 220, respectively.

However, in case the first and second treating units 110 and 120 are arranged in top and bottom portions, the right and left displaying might confuse the user and it is preferred that the display unit 200 is divided into upper and lower regions.

Meanwhile, once the sense step (S1) senses that one of the first and second treating units 110 and 120 is activated, the select request step (S2) may display only the select information S200 of the activated treating unit on the third region 230. At this time, the select information may be the first select information S210 or the second select information S220 (see FIGS. 8 (*b*) and (*c*)).

For example, only the select information S210, S220 of the activated treating unit may be displayed on the full region of the display unit 200 (for example, names).

Accordingly, the user is able to check the activated treating unit and avoid loading clothes in the wrong unit.

In the select request step (S2), the user is able to select the select information S200 by pressing the display unit 200. For example, the user may select the select information S200 by pressing the first region 210 and the second region 220 (see FIG. 9).

In this instance, when trying to select the first and second regions 210 and 220 simultaneously, the user may press the first and second regions 210 and 220 simultaneously in a preset time period or press a OK button (not shown) after pressing the first and second regions 210 and 220.

A course select step (S3) may be implemented to display specific contents of an operation command which is performed in the selected one of the first and second treating units 110 and 120.

Once both the first select information S210 and the second select information S220 are selected in the select request step (S2), the course display step (S3) may display an operation command S310 which is performable in the first treating unit 110 in the first region 210 and an operation command S320 which is performable in the second treating unit 120 in the second region 220 (see FIG. 10 (*a*)).

Accordingly, the user is able to input the operation command S310 implemented in the first treating unit and the operation command S320 implemented in the second treating unit separately.

When the first select information S210 or the second select information S220 is selected in the select request step (S2), an operation command S300 performable in the selected treating unit may be displayed in the third region 230 combined with the first and second regions 210 and 220 (see FIG. 10 (*b*)).

At this time, that the first select information S210 or the second select information S220 is selected in the select request step (S2) may include a case that only one select information is selected even when both of the treating units are activated and a case that the select information of the activated treating unit is selected after the first treating unit or the second treating unit is activated.

Accordingly, the user is able to input the intended operation command to the selected treating unit appropriately.

Meanwhile, when both the first select information s210 and the second select information s220 are selected, the course display step (S3) displays operation commands S310 performable in one of the treating units 110 and 120 in the third region 230. After that, the user selects the operation command performable in the one of the treating units and then the course display step (S3) displays operation commands (S320) performable in the other treating unit in the third region 230 sequentially (see FIG. 10 (*c*)).

In this instance, when desiring to input the operation command S300 to one of the treating units which is not displayed on the third region 230 first, the user may apply a slide force from the first region 210 to the second region 220 of the display unit 200.

Specifically, even though both of the first and second treating units 110 and 120 are selected, contents of the operation commands S300 performable in the treating units are displayed on the display unit 200 sequentially and the user is then able to input the operation commands (S300) without errors.

Meanwhile, once only one of the first select information S210 and the second select information S220 is selected in the select request step (S2), the course display step (S3 may display only the contents of the operation commands S300 performable in the selected treating unit in the third region 230 combined with the first region 210 and the second region 220.

The operation commands S300 may be specific commands for performing at least one of washing and drying cycles in the first and second treating units 110 and 120.

More specifically, the operation commands may include a normal course S330 configured of a course performing one or more of a wash cycle configured to removing foreign substances from clothes, a rinse cycle configured to rinse clothes and a dry cycle configured to dry clothes; and a special course S340 configured of an allergy care cycle configured to keep clothes over a preset specific temperature for a preset time period, a stain-remove cycle configured to remove stains from clothes by increasing the repetition number, duration time and cycle temperature of the preset washing and rinsing cycles.

The normal course (330) may be configured of a normal course S331; a speed wash course S332; a heavy duty course S333; a wool course S334; and a perm press course S335, in case the first treating unit 110 is and the second treating unit 120 are provided as washers. The courses may be displayed on the display unit 200 as icons (see FIG. 10 (*d*)).

The normal course S331 may mean the course configured to perform washing at an average water level, an average duration time, an average water temperature and an average RPM of all the courses or cycles performed in the first or second treating units 110 or 120.

The speed wash course S332 may mean a shortened course with a shorter duration time than the normal course.

The heavy duty course S333 may mean a course for washing relatively heavier clothes than the normal course, with an increased water amount or an increased RPM compared with the average water amount and RPM of the normal course.

The wool course S334 may mean a course configured to perform washing with a lowered water amount and a lowered RPM compared with the average water amount and RPM of the normal course.

The perm press course S335 may mean a course configured to press wrinkles by rotating the drum additionally after ending the spinning cycle.

The special course S340 may be configured of an allergy care course S341; a stain care course S342; a delicate course S343; an outdoor course S344; and a direct wear course S345. The courses may be displayed on the display unit 200 as icons (see FIG. 10 (*d*)).

The outdoor course S343 may mean a course in which the drum is rotated at a higher RPM than the normal course.

The direct wear course S345 may mean a course configured to perform the dry cycle after the wash cycle and then prevent wrinkles by rotating the drum for a preset time period.

The normal course S330 and the special course S340 operated in the selected treating unit after displayed in the course display step (S3) may be displayed in the first region 210 and the second region 220, respectively.

However, if there are many specific courses are provided in the normal course S330 and the special course S340 and displayed in the first region 210 and the second region 220, respectively, the user might fail to recognize each of the courses clearly.

The course display step (S3) may display specific contents or icons of the normal course S330 in the third region 230 of the display unit 200. When an external force for sliding the display unit 200 vertically or horizontally is applied, it is preferred that specific contents or icons of the special course S340 are displayed in the third region 230 (see FIG. 10 (*d*)).

More specifically, when both the first select information and the second select information are selected in the select request step (S2), the course display step (S3) may display first the operation commands S300 performable in one of the first and second treating units 110 and 120 in the third region 230. Hence, when the selection of the operation commands S300 performable in the first treating unit 110 is complete, the course display step (S3) may display operation commands S300 performable in the other treating unit in the third region later.

At this time, when the operation commands S300 performable in one of the first and second treating units 110 and 120 first, the normal course S330 is displayed first. After that, when the slide external force is applied to the display unit 200, the special course S340 may be displayed later.

Meanwhile, the first select information S210 or the second select information S220 may be selected in the select request step (S2), which may include a case of displaying only the selected information of one treating unit in the select request step (S2) after one of the treating units is activated in the sense step (S1) as mentioned above. The course display step (S2) may display only the operation commands performable in the selected treating unit. At this time, the course display step (S2) may display contents of the normal course S330 and contents of the special course S340 in the first region 210 and the second region 220, respectively. Alternatively, one of the normal and special courses S330 and S340 may be displayed in the third region 230 and the other course may be displayed when the external force for sliding is applied.

The control method of the laundry treating apparatus in accordance with the present disclosure may further include a course input sense step (S4) for sensing whether operation commands of the selected treating unit in the course display step (S3) is input.

More specifically, when both the first select information and the second select information are selected in the select request step (S2), the control unit 300 in the course input sense step (S4) may sense whether the operation commands S300 performable in the first treating unit and the operation commands performable in the second treating unit are input in the course display step (S3).

When the first select information or the second select information is selected in the select request step (S2), the control unit 300 in the course input sense step (S4) may sense whether the operation commands S300 performable in the selected treating unit are input.

Unless the operation commands S300 performable in the selected treating unit are input in the course input sense step (S4), the current step returns to the course display step (S3) to induce the user to input the operation command to the selected treating unit.

At this time, the current state may be in standby until the user inputs the operation command or display alarm information for inducing input to the display unit 200.

Meanwhile, even when selecting one of the normal and special courses S330 and S340, the user is likely to intend to perform a specified course in the selected treating unit.

For example, the user is likely to wash or dry specific clothes over or below a preset temperature or strengthen a soaking function for clothes. That is, the user intends to change the contents set in each course to perform a wash or dry cycle for specific clothes.

To reflect those cases, once the operation commands are input in the course display step (S3), a setting change step (S5) may be performed to change one of setting information S500 which includes laundry amount and/or contamination levels S510, temperature S520, drum RPM S540 and rinsing number S530 (see FIG. 11).

The setting change step (S5) is implemented to change one or more of the setting information S500 set in the normal course S330 and the special course S340, to be fitted to the user's intension.

In the setting change step (S5), the setting information S500 is dividedly displayed on the display unit 200. When the divided region is pressed, one or more of changeable setting information 500 may be displayed. One of the displayed changeable setting information S500 is selected and then the setting information is changed into the selected setting information (see FIG. 11).

Accordingly, a personalized wash or dry cycle fitted to the user's intension may be performed.

The user may not intend to change the setting in the setting change step (S5). In other words, the user may usually trust the setting information of the normal and special courses and not intend to change the setting information in the setting change step.

At this time, the control flow of the laundry treating apparatus pauses without changing the setting information in the setting change step (S5), the performing of the operation commands S300 may be delayed.

To prevent that, the preset operation command S300 may be performed in the selected treating unit as it is, unless any inputs are made in the setting change step (S5) for a preset time period.

Once all of the steps mentioned above are completed, the selected treating unit may perform the input operation commands S300.

A process display step (S6) configured to display a process state S600 of the operation command performed in the selected treating unit in the display unit 200 may be performed. The process display step (S6) may provide certain information including the laundry amount S610, the water temperature S620, the drum RPM S630 and the currently processing course S640.

The process display step (S6) may display contents including the remaining time S650, the currently progressing cycle S660 and specific description of the course or cycle (see FIG. 12 (*a*)).

Accordingly, the user is able to check whether the intended operation commands is performed in the selected treating unit and whether the selected treating unit is malfunctioned.

Meanwhile, the control unit 300 may further perform an end determine step (S7) configured to determine whether the operation of the first treating unit 110 and the operation of the second treating unit 120 end, when the first and second treating units 110 and 1200 are ready to perform the operation commands simultaneously.

In the end determine step (S7), the control unit may display only the processing state of the other one, when sensing that one of the first and second treating units 110 and 120 ends the performance of the operation command (see FIG. 12 (*b*)).

In other words, only the operation state of the currently progressing treating unit may be displayed so that the user may be provided with only meaningful information.

As mentioned above, the control unit 300 may provide the user with the display state information of the laundry treating apparatus including the first treating unit 110 and the second treating unit 120 on the display unit 300.

Moreover, the control unit may control the laundry treating apparatus including the first treating unit 110 and the second treating unit 120 by allowing the user to manipulate the display unit 300.

In this instance, the displaying order, input method and contents displayed on the display unit 200 may not be familiar to the user who uses the laundry treating apparatus for the first time.

Accordingly, it is necessary to provide guidelines and explanation about the manipulation method of the display unit 200 to the user who is unfamiliar to the display unit 200.

For that, when the power is supplied to the laundry treating apparatus, the control unit 300 may perform a guide step (S2-1) configured to display guidelines about the manipulation method of the display unit 200.

The guide step (S2-1) may be performed before or after the sense step (S1). In other words, it is after the select request step (S2) that the user starts to manipulate the display unit 200, so that the guide step (S2-1) can be performed before the select request step (S2).

In the guide step (S2-1), start, remove and no re-start of the guidelines to manipulate the display unit 200 and confirm of the start, remove and no re-start may be displayed on divided regions of the display unit 200.

More specifically, icons implemented to display start S221, remove S222, no more of the display unit use guidelines and confirm of the no more guidelines S224 on divided regions of the display unit 200 (see FIG. 13).

The user is able to touch the surface of the display unit 200 which displays icons for the start S221, the remove S222, the no re-start of the use guidelines and no more guidelines S223 and then touch the confirm icon.

At the same time, when the guide step (S2-1) starts, a text message of "check washer usage guidelines" S225 on a center of the display unit 200.

When the user selects the start of the use guidelines, a guideline describe step (S2-2) may be implemented to display specific use guidelines about the manipulation manual of the display unit 200.

The guideline describe step (S2-2) may be configured of select request step (S2) and the course input step (S4) tutorial.

When the user selects the remove of the use guideline, the guide step (S2-1) ends and the select request step (S2) is implemented.

When the user selects the no re-start of the use guideline in the guide step (S2-1), the guide step (S2) may be omitted from the next power-ON.

It is likely to start the guide step (S2) unintendedly or not to repeat the guide step (S2) when a confirm button is additionally displayed. Accordingly, the confirm button is displayed to check the user's intension.

Various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A control method of a laundry treating apparatus, wherein the apparatus comprises:

a first treating unit that comprises a first drum to receive clothes and a first drive portion to rotate the first drum, and that is configured to perform at least one of a wash cycle for removing foreign substances from the clothes or a dry cycle for drying moisture from clothes;

a second treating unit that is located adjacent to the first treating unit and that comprises a second drum to receive other clothes and a second drive portion to rotate the second drum, wherein the second treating unit is configured to perform at least one of the wash cycle or the dry cycle; and a display screen that is located on the laundry treating apparatus and that is configured to display a current state of at least one of the first treating unit or the second treating unit and receive a command that causes at least one of the first treating unit or the second treating unit to perform at least one of the wash cycle or the dry cycle, wherein the display screen is configured to define a first region, a second region, and a third region that includes the first region and the second region, an area of the third region being greater than or equal to a sum of areas of the first region and the second region, wherein the control method comprises:

determining an activation state of one or both of the first treating unit and the second treating unit;

displaying selection information on the display screen;

receiving selection of at least one of the first treating unit or the second treating unit;

based on the selection of the at least one of the first treating unit or the second treating unit, displaying, on the display screen, an operation command performable by a selected treating unit among the first treating unit and the second treating unit;

displaying, on the display screen, a progressing state of the operation command at the selected treating unit, wherein the selection information includes first selection information that allows selection of the first treating unit, and second selection information that allows selection of the second treating unit, wherein displaying the selection information further includes:

based on the determined activation state indicating that one of the first and second treating units is activated, displaying one of the first selection information and the second selection information corresponding to the one of the first and second treating units on the third region in a state in which the other one of the first selection information and the second selection information is not displayed on the display screen, and wherein the determined activation state indicates whether at least one of the first treating unit or the second treating unit is turned on.

2. The control method of claim 1, wherein the display screen is configured to display each of the first selection information, the second selection information, the operation command, and the progressing state (i) dividedly on the first and second regions or (ii) on the third region.

3. The control method of claim 1, further comprising displaying an operation ready state of the laundry treating apparatus on the display screen.

4. The control method of claim 2, wherein the operation command comprises:

a normal course that includes at least one of the wash cycle or a rinse cycle for rinsing clothes; and a special course that includes:

an allergy care course in which clothes are maintained at a predetermined temperature for a preset period of time, or a stain care course including preset wash and rinse cycles that have a repetition number, a duration time, and a cycle temperature greater than those of the normal course.

5. The control method of claim 4, wherein displaying the operation command performable by the selected treating unit includes displaying the normal course and the special course on the first region and on the second region, respectively.

6. The control method of claim 4, wherein displaying the operation command performable by the selected treating unit includes:

displaying the normal course on the third region;

receiving a sliding force input on the display screen; and in response to receiving the sliding force input, displaying the special course on the third region.

7. The control method of claim 1, wherein the progressing state is one of (i) a first progressing state of the first treating unit or (ii) a second progressing state of the second treating unit, and wherein the control method comprises:

based on one of the first and second treating units performing the operation command, displaying corresponding one of the first progressing state or the second progressing state on the third region.

8. The control method of claim 7, wherein displaying the progressing state of the operation command further includes displaying at least one of a current course, a remaining time of the current course, a current cycle, or predetermined detail information of the current course or cycle.

9. The control method of claim 1, further comprising displaying guidelines for manipulation on the display screen based on power being supplied to the laundry treating apparatus.

10. The control method of claim 9, further comprising:

displaying icons for starting display of the guidelines, removing display of the guidelines, disabling re-start of display of the guidelines, and confirming the disabling of re-start of display of the guidelines.

11. The control method of claim 1, wherein the laundry treating apparatus further comprises a control unit configured to:

in a first activation state in which both of the first treating unit and the second treating unit are activated, control the display screen to display the first selection information and the second selection information on the first region and the second region, respectively; and in a second activation state in which one of the first and second treating units is activated, control the display screen to display one of the first selection information and the second selection information corresponding to the activated one of the first and second treating units on the third region in the state in which the other one of the first selection information and the second selection information is not displayed on the display screen.

* * * * *